US008235343B2

(12) United States Patent
Tseng

(10) Patent No.: US 8,235,343 B2
(45) Date of Patent: Aug. 7, 2012

(54) FIXING DEVICE FOR FIXING BACKLIGHT MODULE

(75) Inventor: Shun-Chi Tseng, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 335 days.

(21) Appl. No.: 12/633,869

(22) Filed: Dec. 9, 2009

(65) Prior Publication Data

US 2010/0258697 A1 Oct. 14, 2010

(30) Foreign Application Priority Data

Apr. 8, 2009 (CN) ..... 2009 1 0301413

(51) Int. Cl.
*A47F 5/00* (2006.01)

(52) U.S. Cl. ..... 248/298.1; 248/284.1; 248/346.06; 248/346.07

(58) Field of Classification Search ..... 248/284.1, 248/298.1, 310, 316.4, 346.07, 500, 309.1, 248/314, 346.06, 448, 913
See application file for complete search history.

(56) References Cited

U.S. PATENT DOCUMENTS 4,118,002 A * 10/1978 Bartlett ..... 248/311.2
5,903,645 A * 5/1999 Tsay ..... 379/455
6,811,131 B2 * 11/2004 Kuo ..... 248/346.03
7,988,114 B2 * 8/2011 Coleman et al. ..... 248/298.1
2004/0007651 A1 * 1/2004 Williams et al. ..... 248/346.06
2007/0001078 A1 * 1/2007 Martin et al. ..... 248/298.1
2010/0231518 A1 * 9/2010 Chen ..... 345/168
2011/0017896 A1 * 1/2011 Bordignon ..... 248/310

FOREIGN PATENT DOCUMENTS

CN 1670587 A 9/2005

* cited by examiner

*Primary Examiner* — Ramon Ramirez
(74) *Attorney, Agent, or Firm* — Altis Law Group, Inc.

(57) ABSTRACT

A fixing device includes a base, a first fixing arm, and a second fixing arm. The base has a first guiding slot and a second guiding slot perpendicular to the first guiding slot defined therein. The first fixing arm includes a first guiding rod and a first abutting portion slidably engaged with the first guiding rod. The first guiding rod extends through the first abutting portion and the base at the first guiding slot to move along the first guiding slot. The second fixing arm includes a second guiding rod and a second abutting portion fixedly engaged with the second guiding rod. The second guiding rod extends through the second abutting portion and the base at the second guiding slot to move along the second guiding slot. The first abutting portion and the second abutting portion cooperatively define a receiving space for fixedly receiving the backlight module on the base.

8 Claims, 2 Drawing Sheets

FIXING DEVICE FOR FIXING BACKLIGHT MODULE

BACKGROUND

1. Technical Field

The present disclosure relates to fixing devices for fixing backlight modules.

2. Description of Related Art

Backlight modules are widely used in liquid crystal displays to provide illumination for liquid crystal layers. Before assembled in the liquid crystal display, the backlight module may be tested. During this operation, the backlight module has to be firmly fixed.

Therefore, a fixing device for fixing the backlight module is desired.

DETAILED DESCRIPTION

Figure 1:
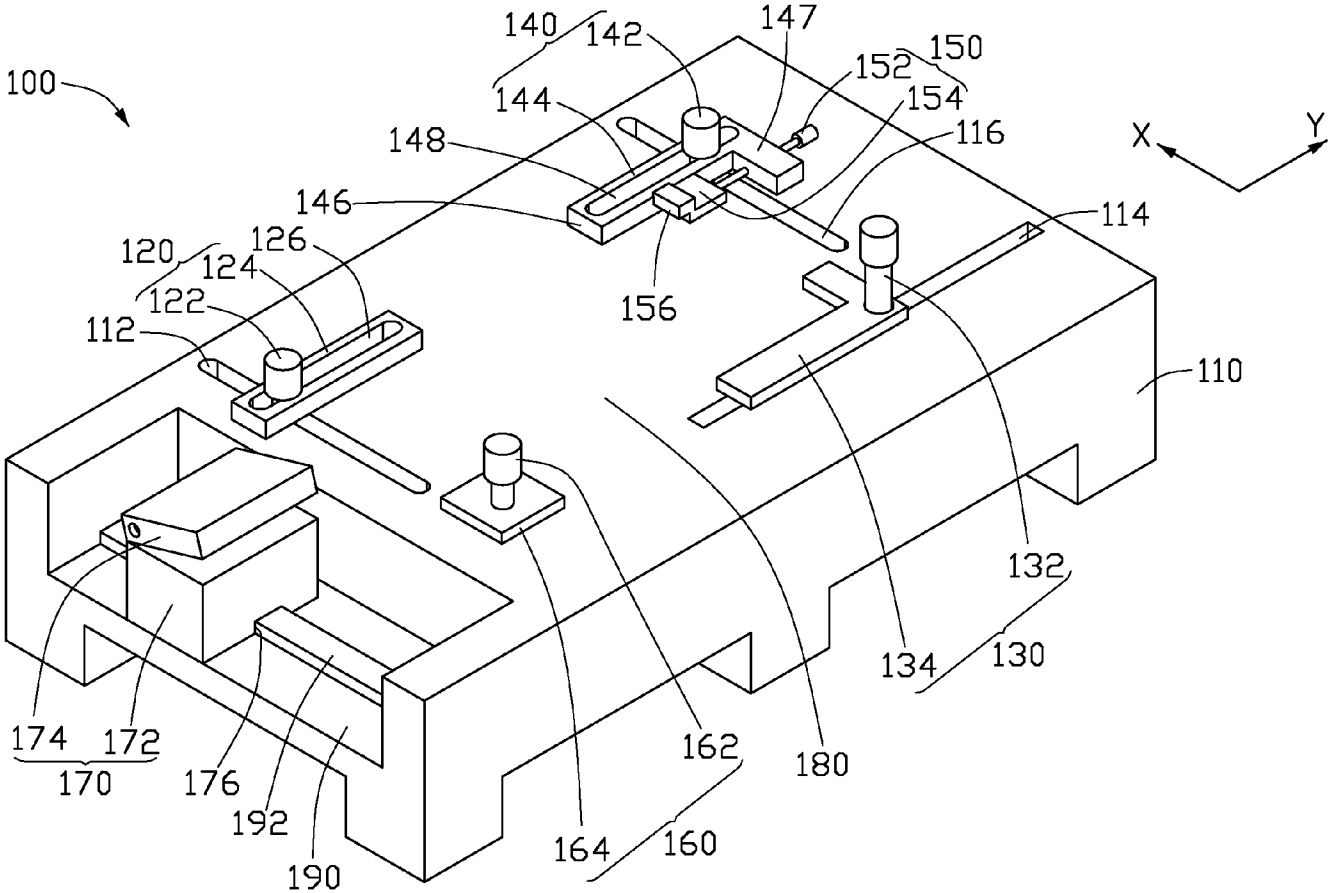
FIG. 1 is an isometric and schematic view of a fixing device, according to an exemplary embodiment.

Referring to FIG. 1, a fixing device 100, according to an exemplary embodiment, includes a base 110, a first fixing arm 120, a second fixing arm 130, a third fixing arm 140, an adjusting member 150, a pressing member 160 and a socket 170.

The base 110 defines a first guiding slot 112, a second guiding slot 114, and a third guiding slot 116. The first guiding slot 112 extends parallel to a first direction X. The second guiding slot 114 extends parallel to a second direction Y. The first direction X is substantially perpendicular to the second direction Y. The second guiding slot 114 is substantially perpendicular to the first guiding slot 112.

The first fixing arm 120 includes a first guiding rod 122 and a first abutting portion 124 slidably engaged with the first guiding rod 122. The first abutting portion 124 is slidable perpendicular to the first guiding rod 122. The first abutting portion 124 defines a first elongated through hole 126 extending substantially perpendicular to the first guiding slot 112. The first guiding rod 122 extends through the first abutting portion 124 at the first elongated through hole 126 and the base 110 at the first guiding slot 112. The first guiding rod 122 together with the first abutting portion 124 moves on the base 110 along the first guiding slot 112. The first abutting portion 124 moves along the first elongated through hole 126.

The second fixing arm 130 includes a second guiding rod 132 and a second abutting portion 134 fixedly engaged with the second guiding rod 132. The second guiding rod 132 is fixed perpendicular to the second abutting portion 134. The second abutting portion 134 is L-shaped. The second guiding rod 132 extends through the base 110 at the second guiding slot 114. The second guiding rod 132 together with the second abutting portion 134 moves on the base 110 along the second guiding slot 114. The first abutting portion 124 and the second abutting portion 134 cooperatively define a receiving space 180 on the base 110. The receiving space 180 is configured for fixedly receiving a backlight module.

The third fixing arm 140 includes a third guiding rod 142 and a third abutting portion 144 engaged with the third guiding rod 142. The third abutting portion 144 is slidable perpendicular to the third guiding rod 142. The third abutting portion 144 is L-shaped and includes a fixing part 146 extending substantially perpendicular to the third guiding slot 116 and a supporting part 147 extending substantially perpendicular to the fixing part 146. The fixing part 146 defines a second elongated through hole 148 substantially perpendicular to the third guiding slot 116. The third guiding rod 142 extends moveably through the fixing part 146 at the second elongated through hole 148 and the base 110 at the third guiding slot 116. The third guiding rod 142 together with the third abutting portion 144 moves on the base 110 along the third guiding slot 116. The third abutting portion 144 moves along the second elongated through hole 148.

The adjusting member 150 includes an adjusting rod 152 and an abutting block 154. The adjusting rod 152 extends moveably through the supporting part 147. The adjusting rod 152 is perpendicular to the third guiding slot 116. The abutting block 154 is fixedly mounted to an end surface of the adjusting rod 152 in the receiving space 180. The abutting block 154 is stepped and includes an abutting surface 156 extending parallel to the third guiding slot 116.

The pressing member 160 includes a bolt 162 and a pressing plate 164. The bolt 162 extends through the pressing plate 164 and is screwed into the base 110.

The base 110 further defines a receiving recess 190 and includes a guiding rail 192. The receiving recess 190 is at an edge of the base 110. The guiding rail 192 is in the receiving recess 190. The guiding rail 192 extends parallel to the first guiding slot 112. The socket 170 includes a body 172 and a cover 174 pivotally connected to the body 172. The body 172 defines a guiding groove 176 at a bottom thereof. The body 172 is slidably engaged with the guiding rail 192 at the guiding groove 176 so that the socket 170 is slidably reengaged in the receiving recess 190. The body 170 may be connected to an outer power source (not shown).

It is to be understood that the first guiding rod 122, the second guiding rod 132 and the third guiding rod 142 may be threaded rods and can be fixed on the base 110 by fasteners, such as nuts.

Figure 2:
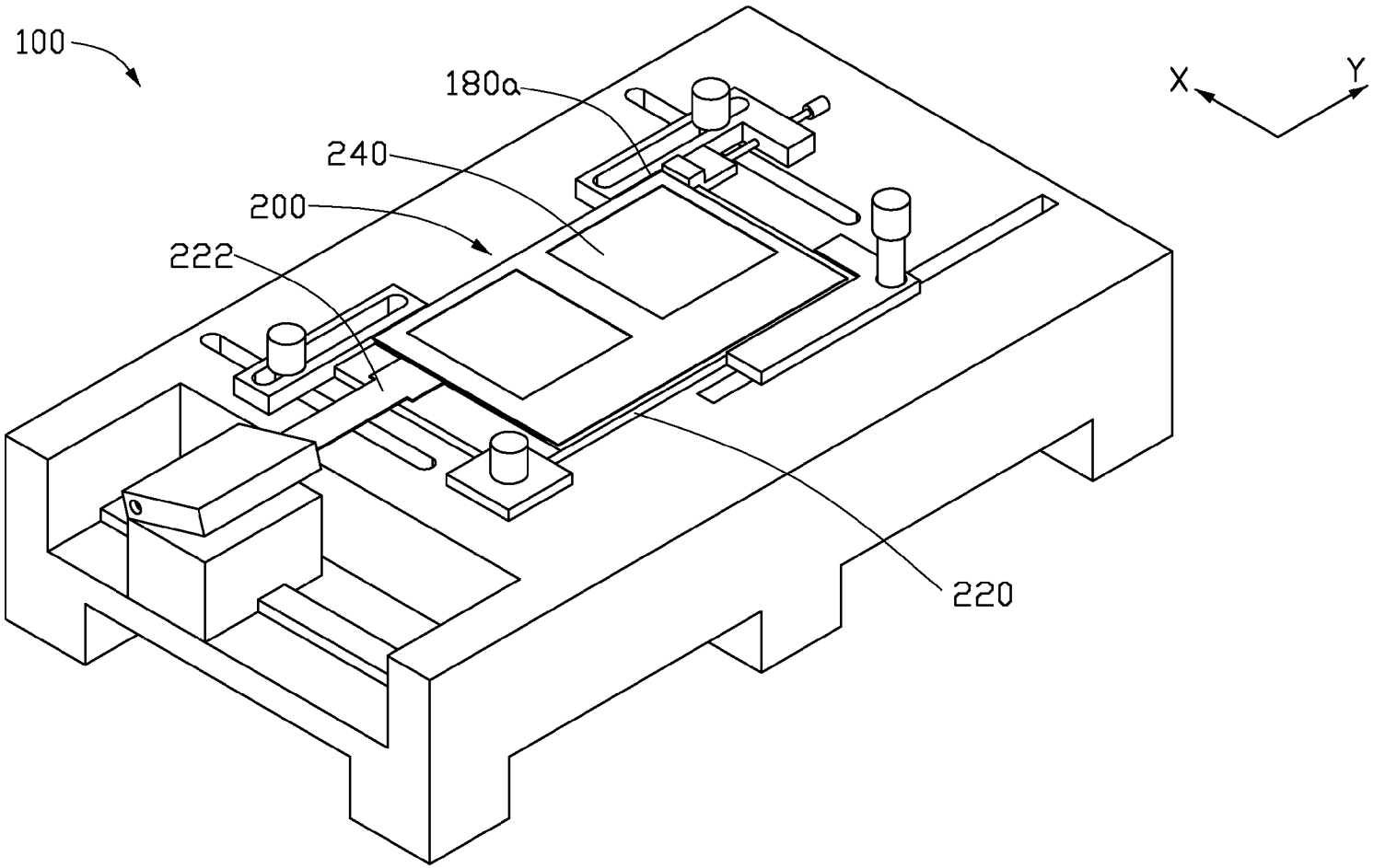
FIG. 2 shows an example of the fixing device used for fixing a backlight module.

Referring to FIGS. 1 and 2, an example of the fixing device 100 used for fixing a backlight module 200 is shown. The backlight module 200 includes a circuit board 220, a light guide plate 240 mounted on the circuit board 220, a reflective plate (not shown) and a plurality of light sources (not shown) electrically positioned on the circuit board 220. The circuit board 220 includes a connector 222 for facilitating an electrical connection between the light sources and the socket 170.

The receiving space 180 is adjusted by positioning the first fixing arm 120, the second fixing arm 130, the third fixing arm 140 and the adjusting member 150 to fit the circuit board 220 of the backlight module 200. The pressing plate 164 is raised away from the base 110 at a distance greater than a thickness of the circuit board 220. Then, the circuit board 220 is placed on the base 110 in the receiving space 180. The first fixing arm 120, the second fixing arm 130, the third fixing arm 140, and the adjusting member 150 are repositioned such that the first abutting portion 124, the second abutting portion 134, the third abutting portion 144, and the adjusting member 150 abut sides of the circuit board 220. The pressing plate 164 is lowered by the bolt 162 to firmly press the circuit board 220. The connector 222 of the circuit board 220 is plugged into the body 172 of the socket 170 and the cover 174 is closed to fix the connector 222 on the body 172.

The abutting surface 156 of the adjusting member 150 and a side of the fixing part 144 cooperatively form a L-shaped receiving space 180*a*. The L-shaped receiving space 180*a* facilitates as an aligning guide to quickly assembling the reflective plate and the light guide plate 240 at a designed position of the circuit board 220. The reflective plate is sandwiched between the circuit board 220 and the light guide plate 240. Therefore, the backlight module 200 is firmly fixed.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A fixing device for fixing a backlight module, comprising:

a base having a first guiding slot and a second guiding slot defined therein, the first guiding slot extending substantially perpendicular to the second guiding slot;

a first fixing arm comprising a first guiding rod and a first abutting portion slidably engaged with the first guiding rod, the first guiding rod extending through the first abutting portion and the base at the first guiding slot to move along the first guiding slot; and a second fixing arm comprising a second guiding rod and an L-shaped second abutting portion fixedly engaged with the second guiding rod, the second guiding rod extending through the second abutting portion and the base at the second guiding slot to move along the second guiding slot, the first abutting portion and the second abutting portion cooperatively defining a receiving space for fixedly receiving the backlight module on the base.

2. The fixing device of claim 1, further comprising a third fixing arm, the third fixing arm comprising a third guiding rod and an L-shaped third abutting portion engaged with the third guiding rod, the base further having a third guiding slot defined parallel to and spaced from the first guiding slot, and the third guiding rod extending through the third abutting portion and the base at the third guiding slot to move along the third guiding slot, the first abutting portion, the second abutting portion and the third abutting portion cooperatively defining the receiving space.

3. The fixing device of claim 2, further comprising an adjusting member, the adjusting member comprising an adjusting rod and an abutting block, the third abutting portion comprising a fixing part extending substantially perpendicular to the third guiding slot and a supporting part extending substantially perpendicular to the fixing part, the adjusting rod extending moveably through the supporting part, the abutting block fixedly mounted to an end surface of the adjusting rod in the receiving space.

4. The fixing device of claim 3, wherein the abutting block is stepped and comprises an abutting surface extending parallel to the third guiding slot.

5. The fixing device of claim 1, further comprising a pressing member, the pressing member comprising a bolt and a pressing plate, the bolt extending through the pressing plate and screwed into the base.

6. The fixing device of claim 1, further comprising a socket, the base further having a receiving recess defined at an edge thereof, the socket moveably engaged in the receiving recess.

7. The fixing device of claim 6, wherein the socket comprises a body and a cover pivotally connected to the body.

8. The fixing device of claim 7, wherein the base further comprises a guiding rail arranged parallel to the first guiding slot in the receiving recess, and the body has a guiding groove defined at a bottom thereof, and is slidably engaged with the guiding rail at the guiding groove.

* * * * *